US008967060B2

(12) United States Patent
Fujihara

(10) Patent No.: US 8,967,060 B2
(45) Date of Patent: Mar. 3, 2015

(54) SEWING MACHINE

(71) Applicant: Shinya Fujihara, Obu (JP)

(72) Inventor: Shinya Fujihara, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 21 days.

(21) Appl. No.: 13/891,893

(22) Filed: May 10, 2013

(65) Prior Publication Data

US 2013/0312648 A1 Nov. 28, 2013

(30) Foreign Application Priority Data

May 25, 2012 (JP) ..... 2012-119381

(51) Int. Cl.

| | |
|---|---|
| ***D05B 77/00*** | (2006.01) |
| ***D05B 23/00*** | (2006.01) |
| ***D05B 69/14*** | (2006.01) |
| ***D05B 73/00*** | (2006.01) |
| *D05B 75/00* | (2006.01) |

(52) U.S. Cl.

CPC ..... *D05B 23/00* (2013.01); *D05B 69/14* (2013.01); *D05B 73/005* (2013.01)

USPC ..... 112/270; 112/261

(58) Field of Classification Search

CPC ..... D05B 43/00; D05B 79/00; D05B 77/00; D05B 51/00; D05B 19/12; D05B 75/00; D05B 75/92; D05B 75/04; D05B 75/06; D05B 73/00

USPC ..... 312/223.1; 112/258, 259, 260, 250, 112/270, 302, 261

See application file for complete search history.

(56) References Cited

U.S. PATENT DOCUMENTS

| | | | | |
|---|---|---|---|---|
| 2,816,807 | A * | 12/1957 | Bono | 312/30 |
| 2,848,963 | A * | 8/1958 | Johnson | 112/444 |
| 3,761,152 | A * | 9/1973 | Cory | 312/7.2 |
| 4,301,753 | A * | 11/1981 | Meier | 112/470.04 |
| 4,690,466 | A * | 9/1987 | Bakr et al. | 312/29 |
| 7,114,455 | B2 * | 10/2006 | Prufer et al. | 112/302 |
| 7,134,877 | B2 * | 11/2006 | Matumoto et al. | 434/379 |

FOREIGN PATENT DOCUMENTS

| | | |
|---|---|---|
| JP | A-2000-37584 | 2/2000 |
| JP | A-2006-193883 | 7/2006 |

* cited by examiner

*Primary Examiner* — Ismael Izaguirre
(74) *Attorney, Agent, or Firm* — Oliff PLC

(57) ABSTRACT

A sewing machine includes a frame portion, a lid member, and a control portion. The lid member is attached to the frame portion such that the lid member can open and close. The control portion is configured to control a movement speed of the lid member depending on an aperture of the lid member.

9 Claims, 5 Drawing Sheets

SEWING MACHINE

CROSS-REFERENCE TO RELATED APPLICATION

This application claims priority to Japanese Patent Application No. 2012-119381, filed May 25, 2012, the content of which is hereby incorporated herein by reference in its entirety.

BACKGROUND

The present disclosure relates to a sewing machine to which a lid member is attached.

Various types of lid member are attached to a sewing machine. For example, a lid member is attached to a frame portion that is provided on an upper portion of a sewing machine, such that the lid member can open and close. In a closed state, the lid member covers an open space provided on the upper portion of the sewing machine. For example, a thread spool storage portion and a thread guard etc. are arranged in the open space. When replacing the thread spool and so on, the lid member is opened and closed by a user.

Various technologies are being considered to improve operability when opening and closing the lid member attached to the sewing machine. For example, a sewing machine is known that is provided with a spring portion and a damper portion. The spring portion urges the lid member in a direction to open the lid member. The damper portion performs deceleration control of a rotation of the lid member in the course of the spring member causing the lid member to move to an open position.

SUMMARY

With the above-described sewing machine, because the lid member is being urged in the direction to open the lid member, a relatively large amount of force is required when closing the lid member. For that reason, there is a case in which an excessive amount of force is applied to the lid member when closing the lid member. When the excessive amount of force is applied to the lid member, the lid member impacts against the frame portion with a lot of momentum, and this sometimes causes a large noise. Thus, there is demand to further improve the operability when opening and closing the lid member that is attached to the sewing machine.

Various embodiments of the broad principles derived herein provide a sewing machine with improved operability when opening and closing a lid member.

Embodiments provide a sewing machine that includes a frame portion, a lid member, and a control portion. The lid member is attached to the frame portion such that the lid member can open and close. The control portion is configured to control a movement speed of the lid member depending on an aperture of the lid member.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. Note that the drawings are used to explain technological features that the present disclosure can utilize, and configurations etc. of devices that are described are simply explanatory examples.

A physical configuration of a sewing machine 1 will be explained with reference to FIG. 1. In the following explanation, the up-down direction and the left-right direction in FIG. 1 are, respectively, the up-down direction and the left-right direction of the sewing machine 1.

Figure 1:
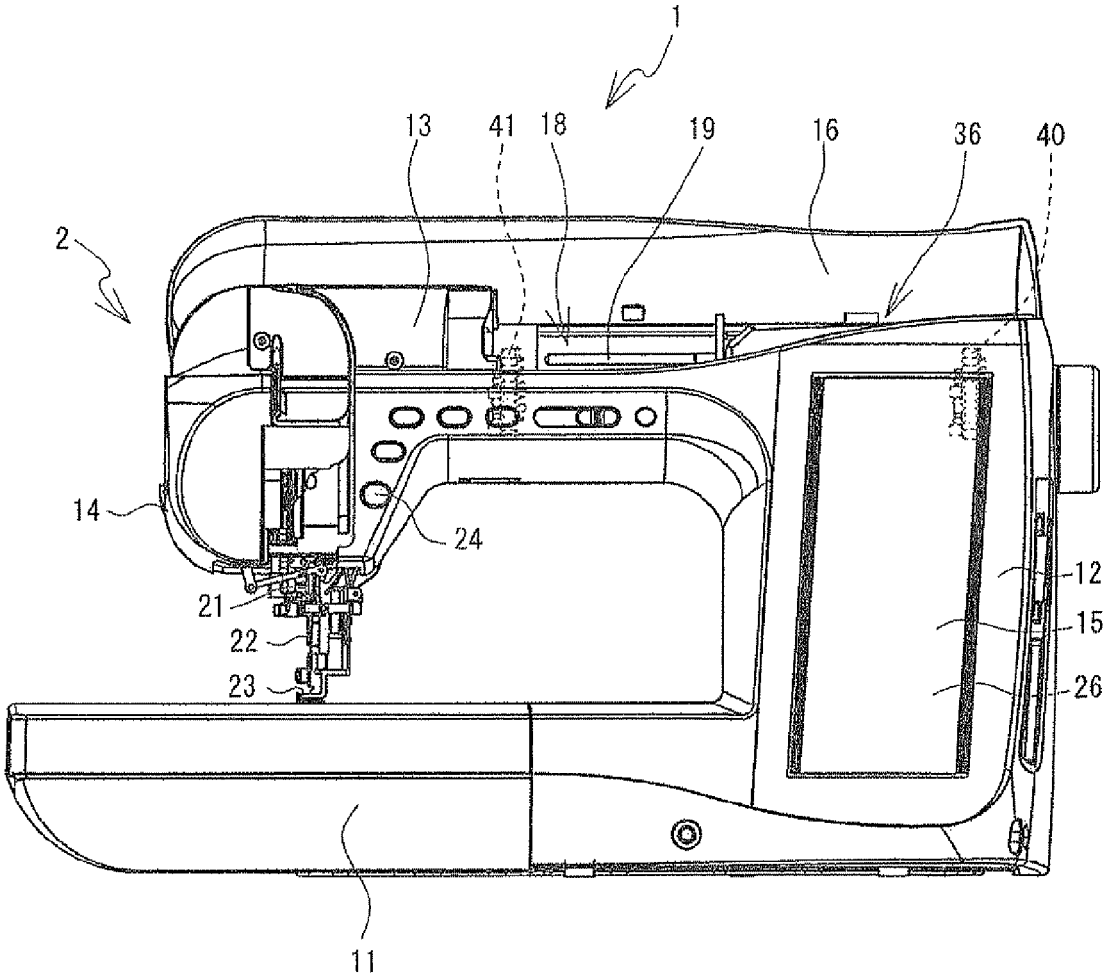
FIG. 1 is a front view of a sewing machine when a lid member is open.

As shown in FIG. 1, a main body 2 of the sewing machine 1 is mainly provided with a bed portion 11, a pillar 12, and an arm portion 13. The pillar 12 extends upward from the right end of the bed portion 11. The arm portion 13 extends to the left from the upper end of the pillar 12 such that the arm portion 13 faces the bed portion 11. The leading end of the arm portion 13 is a head portion 14.

A vertically rectangular liquid crystal display (hereinafter referred to as an "LCD") 15 is provided on the front face of the pillar 12. An image including various items, such as commands, illustrations, setting values and messages may be displayed on the LCD 15. A touch panel 26 is provided in the front surface of the LCD 15.

A frame portion 36 is provided on the upper portion of the arm portion 13. A lid member 16 is attached to the frame portion 36. The lid member 16 is attached to the frame portion 36 by control units 40 and 41 such that the lid member 16 can open and close. The control units 40 and 41 are detachably supported by the frame portion 36. When the lid member 16 is removed from the frame portion 36, the lid member 16 can be removed together with the control units 40 and 41. The control units 40 and 41 are configured to control a movement speed of the lid member 16 depending on an aperture of the lid member 16. The control units 40 and 41 will be explained in more detail later.

In a state in which the lid member 16 is completely closed, a thread storage portion 18 is below the lid member 16, more specifically, in a generally center portion inside the arm portion 13. Hereinafter, the state in which the lid member 16 is completely closed is referred to as a "closed state." The thread storage portion 18 is a recessed portion in which a thread spool (not shown in the drawings) can be housed. A thread spool pin 19, which protrudes to the left toward the head portion 14, is provided on an inner wall surface of the thread storage portion 18 on the pillar 12 side. When the thread spool pin 19 is inserted through an insertion hole (not shown in the drawings) formed in the thread spool, the thread spool is mounted in the thread storage portion 18.

An upper thread (not shown in the drawings) that is wound on the thread spool may be supplied to a sewing needle 22 that is attached to a needle bar 21. The upper thread may be supplied from the thread spool to the sewing needle 22 via a thread guard (not shown in the drawings) that is provided on the head portion 14. The needle bar 21 may be driven to move in the up-down direction by a needle bar up-and-down drive mechanism (not shown in the drawings) that is provided in the head portion 14. The needle bar up-and-down drive mechanism may be driven by a drive shaft (not shown in the drawings) that is driven to rotate by a sewing machine motor (not shown in the drawings). A presser bar (not shown in the drawings) extends downward from the lower end of the head portion 14. A presser foot 23, which can press a work cloth (not shown in the drawings), is replaceably attached to the presser bar. A plurality of operation switches, including a start-and-stop switch 24, are provided on a lower portion on the front surface of the arm portion 13.

Figure 2:
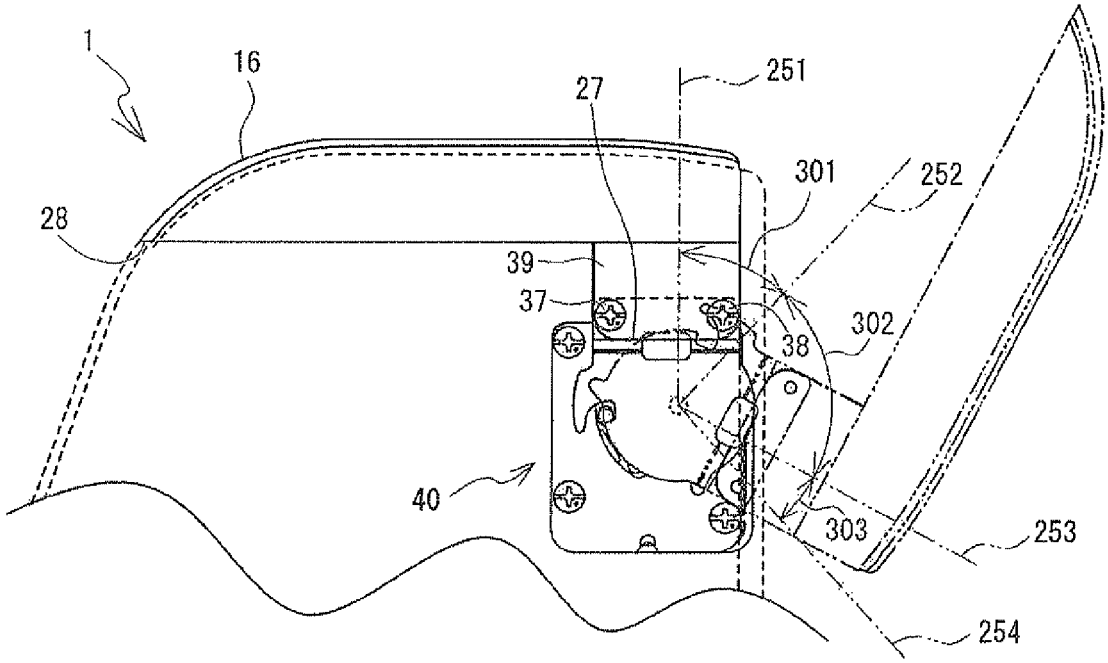
FIG. 2 is a schematic diagram of the lid member and a control unit as seen from the right side.
Figure 3:
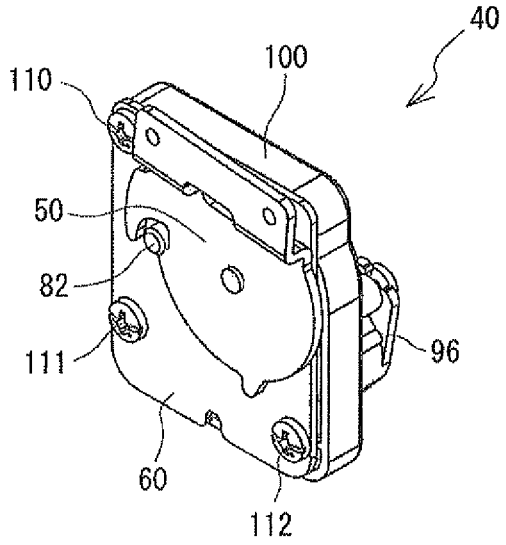
FIG. 3 is a perspective view of the control unit.

A configuration of the control units 40 and 41 will be explained in detail with reference to FIG. 2 to FIG. 4. The control units 40 and 41 each have the same configuration. Therefore, the configuration of the control unit 40 will be explained in detail, and an explanation of the control unit 41 will be omitted. Lower left, upper right, upper left, lower right, up and down in FIG. 4 correspond, respectively, to the right, the left, the front, the rear, the top and the bottom of the control unit 40.

Figure 4:
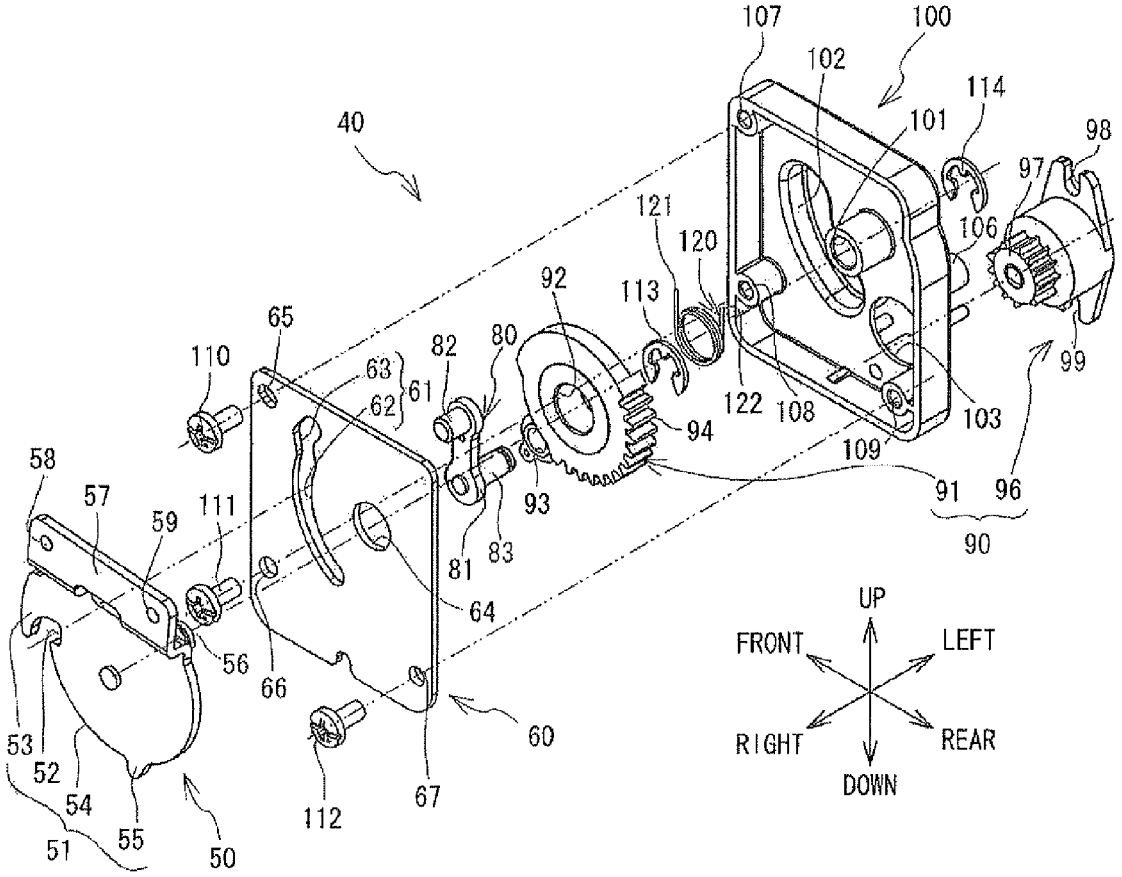
FIG. 4 is an exploded perspective view of the control unit.

As shown in FIG. 4, the control unit 40 includes an engagement member 50, a cam plate 60, a contactor 80, a damper member 90, a base 100 and a torsion spring 120. Each of the structural members that configure the control unit 40 is formed of metal or plastic, for example.

The engagement member 50 includes a cam portion 51, a shaft 56 and an attachment portion 57. A case in which a movement speed of the lid member 16 is adjusted by the control unit 40 and a case in which the movement speed is not adjusted can be switched depending on whether the cam portion 51 engages with an engagement pin 82 of the contactor 80. The cam portion 51 includes a first engagement portion 52, a protruding portion 53, an arc-shaped portion 54 and a second engagement portion 55. The first engagement portion 52 is a part that is cut out, in a right side view, from an outer side of the engagement member 50 toward the shaft 56. The protruding portion 53 is a part that protrudes, in the right side view, from the shaft 56 toward the outside, and a leading end portion of the protruding portion 53 protrudes in the anti-clockwise direction. The arc-shaped portion 54 is a part that is arc-shaped in the right side view, centering on the shaft 56. The second engagement portion 55 is a part that protrudes, in the right side view, from the shaft 56 toward the outside of the engagement member 50. The shaft 56 protrudes to the left from the left side surface of the engagement member 50. The engagement member 50 can rotate around the shaft 56. The attachment portion 57 is a part that may be used to fix the engagement member 50 to an attachment portion 39 (refer to FIG. 2) that is provided on the lid member 16. Screw holes 58 and 59 are formed, respectively, on a front portion and a rear portion of the attachment portion 57. The lid member 16 may be coupled with the engagement member 50 by a screw 37 (refer to FIG. 2) that is inserted into the screw hole 58 and by a screw 38 (refer to FIG. 2) that is inserted into the screw hole 59.

The cam plate 60 is a flat plate having a generally rectangular shape in a right side view. In a state in which the control unit 40 is attached to the frame portion 36, the cam plate 60 is fixed with respect to the frame portion 36. The cam plate 60 includes a cam groove 61, a shaft hole 64 and holes 65 to 67. The cam groove 61 determines a movement path of the contactor 80 when the lid member 16 moves. The cam groove 61 includes a first cam groove 62 and a second cam groove 63. Both the first cam groove 62 and the second cam groove 63, respectively, form an arc-shaped hole centering around the shaft hole 64 in the right side view. The upper portion of the first cam groove 62 is joined to the lower portion of the second cam groove 63. The inner arc radius of the first cam groove 62 is smaller than the arc radius of the arc-shaped portion 54 of the engagement member 50. The inner arc radius of the second cam groove 63 corresponds to the arc radius of the arc-shaped portion 54 of the engagement member 50. The shaft 56 of the engagement member 50 may be inserted into the shaft hole 64. The holes 65 to 67 are formed, respectively, in the upper left portion, the lower left portion and the lower right portion of the cam plate 60 in the right side view. The cam plate 60 may be fixed to the base 100 by screws 110 to 112 that are respectively inserted into the holes 65 to 67.

The contactor 80 is configured to come into contact with the cam groove 61 that is formed in the cam plate 60 and move along the cam groove 61. When the lid member 16 moves within a range that will be explained later, the contactor 80 moves on the path that is determined by the cam groove 61, while engaging with the engagement member 50. The contactor 80 is configured to be coupled with the damper member 90. The contactor 80 includes a plate portion 81, the engagement pin 82 and a shaft 83. The plate portion 81 is a plate that connects the engagement pin 82 and the shaft 83. The engagement pin 82 protrudes to the right from the right side surface of the plate portion 81. When the control unit 40 is assembled, the engagement pin 82 is in a state of being inserted through the first cam groove 62 or the second cam groove 63. The shaft 83 extends to the left from the left side surface of the plate portion 81.

The damper member 90 is a member that is configured to regulate a movement speed of the lid member 16 when the lid member 16 is moved by a force applied to the lid member 16 by a user, and by the urging force of the torsion spring 120. The damper member 90 includes a wheel 91 and a damper 96. The wheel 91 is a plate member having a generally circular shape in the right side view. The wheel 91 is configured to be coupled, respectively, to the contactor 80 and the damper 96. The wheel 91 includes shaft holes 92 and 93, a groove portion (not shown in the drawings) and a gear portion 94. The shaft 56 of the engagement member 50 is inserted into the shaft hole 92. The shaft 83 of the contactor 80 is inserted into the shaft hole 93. A retaining ring 113 is attached to the leading end portion on the left side surface side of the shaft 83. The contactor 80 may be coupled to the damper member 90 in this manner. The groove portion is formed on the left side surface of the wheel 91. The groove portion latches a first arm portion 121 of the torsion spring 120. The gear portion 94 is a sector gear that centers around the shaft hole 92. The damper 96 is a so-called rotary damper. The damper 96 is configured to regulate a rotational operation of the wheel 91. The damper 96 includes a gear portion 97 and attachment portions 98 and 99. The gear portion 97 may mesh with the gear portion 94 of the wheel 91.

The base 100 is a box-shaped member having a generally rectangular shape in the right side view. The base 100 is configured to support the engagement member 50, the cam plate 60, the contactor 80, the damper member 90 and the torsion spring 120. The base 100 includes a shaft hole 101, a recessed portion 102, an attachment hole 103, an attachment portion 106 and screw holes 107 to 109. The shaft 56 of the engagement member 50 may be inserted into the shaft hole 101. The recessed portion 102 is a portion that is indented from the right side surface side to the left side surface side. Due to the formation of the recessed portion 102, the shaft 83 does not come into contact with the base 100 when the contactor 80 moves. In a state in which the gear portion 97 penetrates through the attachment hole 103, the damper 96 is fixed to the left side surface of the base 100 by a screw that is not shown in the drawings. The screw holes 107 to 109 are formed, respectively, in the upper left portion, the lower left portion and the lower right portion of the base 100 in the right side view. The screws 110 to 112 are respectively screwed into the screw holes 107 to 109.

The shaft 56 of the engagement member 50 may be inserted into the shaft hole 64, the shaft hole 92 and the shaft hole 101. A retaining ring 114 may be attached to the leading end of the shaft 56 on the left side surface side. The torsion spring 120 urges the engagement member 50, via the wheel 91, in the direction of closing the lid member 16. The first arm portion 121 of the torsion spring 120 is latched into the groove portion (not shown in the drawings) of the wheel 91, and a second arm portion 122 is latched into a hole (not shown in the drawings) that is formed in the upper right portion of the base 100 in the right side view.

A mechanism by which the control units 40 and 41 control the movement speed of the lid member 16 will be explained with reference to FIG. 2 and FIG. 5. The lid member 16 may be opened and closed by the user when replacing the thread spool, for example. In the present embodiment, the control units 40 and 41 are configured to control the movement speed of the lid member 16 depending on an aperture of the lid member 16. The aperture indicates to what extent the lid member 16 is open. In the present embodiment, the aperture of the lid member 16 is defined in the following manner. The aperture is calculated based on a perpendicular line that passes through the shaft 56 of the engagement member 50 and that intersects perpendicularly with a side 27 (refer to FIG. 2). The side 27 is the lower edge of the attachment portion 39 (refer to FIG. 2) of the lid member 16. The shaft 56 is a center of rotation when the lid member 16 moves rotationally. As shown in FIG. 2, in a closed state, in which the lid member 16 is completely closed, the aperture is zero.

A line 251 is a perpendicular line when the lid member 16 is in the closed state. A line 254 is a perpendicular line when the lid member 16 is in a state of being open to a maximum extent. The state of the lid member 16 being open to the maximum extent is hereinafter simply referred to as a "completely open state". Hereinafter, a range that is between the line 251 and the line 254 is referred to as an aperture range of the lid member 16. In the present embodiment, the aperture range of the lid member 16 is divided into three ranges, namely, a first range 301, a middle range 302 and a second range 303. The first range 301 is a continuous range that includes the aperture of the lid member 16 in the closed state. Specifically, the first range 301 is a range that corresponds to a case in which the lid member 16 is in the closed state and a state in which the lid member 16 is almost closed. The second range 303 is a continuous range that includes the aperture of the lid member 16 when the lid member 16 is in the completely open state. Specifically, the second range 303 is a range that corresponds to a case in which the lid member 16 is in the completely open state and a state in which the lid member 16 is almost completely open. The middle range 302 is a range that is located between the first range 301 and the second range 303. A line 252 is a perpendicular line that corresponds to a case in which the aperture of the lid member 16 is on a boundary between the first range 301 and the middle range 302. A line 253 is a perpendicular line that corresponds to a case in which the aperture of the lid member 16 is on a boundary between the middle range 302 and the second range 303. The control unit 40 is configured to adjust the movement speed of the lid member 16 when the aperture of the lid member 16 is within the first range 301 or within the second range 303. When the aperture of the lid member 16 is within the middle range 302, the control unit 40 does not adjust the movement speed of the lid member 16. The control unit 40 is configured to switches between adjusting the movement speed of the lid member 16 and not adjusting the movement speed of the lid member 16 depending on whether the engagement member 50 rotates while engaging with the contactor 80. In this way, the control unit 40 enhances operability when opening and closing the lid member 16 and also operates to reliably close the lid member 16.

Figure 5:
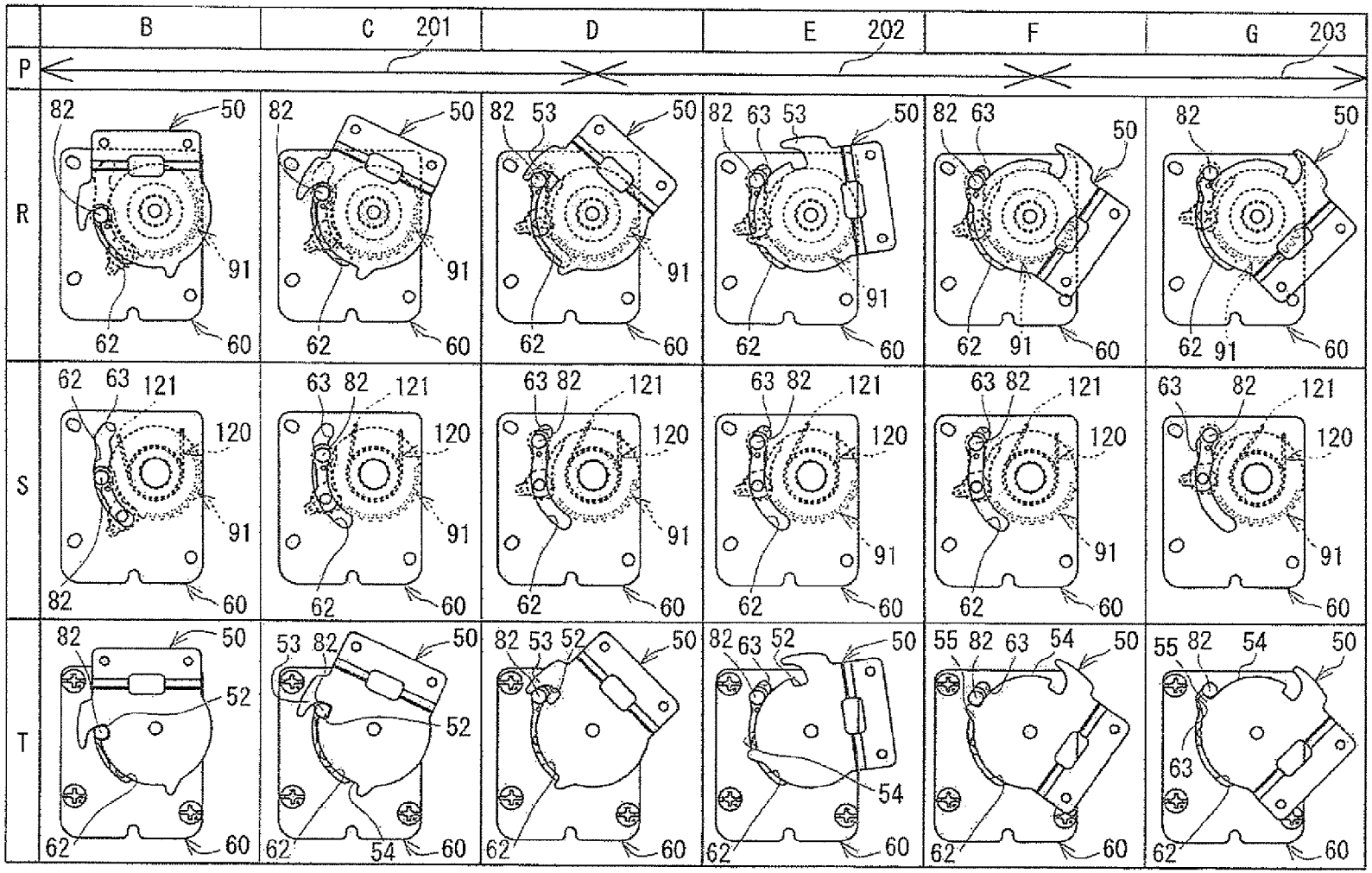
FIG. 5 is a diagram showing changes in positional relationships of respective members, in a process in which an engagement member rotates in accordance with opening and closing of the lid member.

FIG. 5 shows changes in positional relationships of respective members, when the control unit 40 is seen in a right side view, over the course of the rotation of the engagement member 50 in accordance with the opening and closing of the lid member 16. Row P in FIG. 5 indicates the aperture range of the lid member 16. A range indicated by an arrow 201 corresponds to the first range 301 shown in FIG. 2. A range indicated by an arrow 202 corresponds to the middle range 302 shown in FIG. 2. A range indicated by an arrow 203 corresponds to the second range 303 shown in FIG. 2. Row R shows positional relationships among the engagement member 50, the cam plate 60, the engagement pin 82 of the contactor 80 and the wheel 91. Row S shows positional relationships among the cam plate 60, the engagement pin 82 of the contactor 80 and the torsion spring 120. In row S, an illustration of the engagement member 50 is omitted. Row T shows positional relationships among the engagement member 50, the cam plate 60 and the engagement pin 82 of the contactor 80.

Columns in FIG. 5 show the positional relationships of the respective members of the control unit 40 at specific apertures of the lid member 16. More specifically, column B shows the closed state of the lid member 16. Column C shows a state in which the aperture of the lid member 16 is within the first range 301. Column D shows a state in which the aperture of the lid member 16 is on the boundary between the first range 301 and the middle range 302. Column E shows a state in which the aperture of the lid member 16 is within the middle range 302. Column F shows a state in which the aperture of the lid member 16 is on the boundary between the middle range 302 and the second range 303. Column G shows the completely open state of the lid member 16.

When the lid member 16 is in the closed state, the engagement pin 82 of the contactor 80 is in contact with the first cam groove 62 and engages with the first engagement portion 52, as shown in column B in FIG. 5. When the user opens the lid member 16 that is in the closed state, the user lifts up a front edge portion 28 (refer to FIG. 2) of the lid member 16. The lid member 16 moves by rotating in the clockwise direction in the right side view, rotating around the shaft 56 of the control units 40 and 41. When the aperture of the lid member 16 is within the first range 301, the engagement member 50 rotates while engaging with the engagement pin 82 of the contactor 80, as shown in column C in FIG. 5. The engagement pin 82 of the contactor 80 moves on a first path along the cam plate 60 while being supported by the first engagement portion 52 of the engagement member 50. The first path of the present embodiment is a path along the first cam groove 62 of the cam plate 60. As shown in row S, column C in FIG. 5, the first arm portion 121 of the torsion spring 120 rotatingly moves in accordance with the rotation of the wheel 91, and an angle of deflection increases.

When the aperture of the lid member 16 is within the first range 301, an urging force is applied to the engagement member 50 by the deflection of the first arm portion 121 of the torsion spring 120. More specifically, the lid member 16 is urged in the direction of closing (in the anti-clockwise direction in the right side view) by the torsion spring 120, when the aperture of the lid member 16 is within the first range 301. Further, when the aperture of the lid member 16 is within the first range 301, the movement speed of the lid member 16 is regulated by the damper member 90. Thus, when the aperture of the lid member 16 is within the first range 301, the movement speed of the lid member 16 is adjusted by the control units 40 and 41. Specifically, the movement speed of the lid member 16, which is defined by a difference between a force applied by the user in the direction to open the lid member 16 and the urging force applied in the direction of closing by the torsion spring 120, is regulated by the damper 96.

When the aperture of the lid member 16 reaches the boundary between the first range 301 and the middle range 302, the engagement member 50 that is engaged with the engagement pin 82 releases the engagement with the engagement pin 82 of the contactor 80. The engagement pin 82 of the contactor 80 is guided along the cam groove 61 by the protruding portion 53. The engagement pin 82 moves from the first cam groove 62 toward the second cam groove 63, and moves from the uppermost portion of the first cam groove 62 to the lowermost portion of the second cam groove 63. When the aperture of the lid member 16 reaches the boundary between the first range 301 and the middle range 302, the engagement member 50 releases the engagement with the engagement pin 82 of the contactor 80, as shown in column D in FIG. 5. When the aperture of the lid member 16 is within the middle range 302, the engagement pin 82 of the contactor 80 is positioned at the lowermost portion of the second cam groove 63, as shown in column E in FIG. 5. As the engagement member 50 and the engagement pin 82 are not engaged with each other, even if the lid member 16 moves, the engagement pin 82 of the contactor 80 does not move. Further, the first arm portion 121 of the torsion spring 120 does not rotatingly move. Meanwhile, the engagement member 50, which is not engaged with the engagement pin 82 of the contactor 80, may rotate around the shaft 56. At this time, the urging force of the torsion spring 120 does not act on the engagement member 50. Specifically, the lid member 16 is not urged by the torsion spring 120. Further, the movement speed of the lid member 16 is not regulated by the damper member 90. Thus, when the aperture of the lid member 16 is within the middle range 302, the movement speed of the lid member 16 is not adjusted by the control units 40 and 41.

When the aperture of the lid member 16 reaches the boundary between the middle range 302 and the second range 303, the second engagement portion 55 of the engagement member 50 comes into contact with the engagement pin 82 of the contactor 80, as shown in column F. In this manner, the engagement member 50 engages with the engagement pin 82 of the contactor 80. When the aperture of the lid member 16 is within the second range 303, the engagement member 50 rotates around the shaft 56 of the engagement member 50 while engaging with the engagement pin 82 of the contactor 80, as shown in column G. The engagement pin 82 of the contactor 80 moves on a second path along the cam plate 60 while being supported by the second engagement portion 55 of the engagement member 50. The second path of the present embodiment is a path along the second cam groove 63 of the cam plate 60. When the aperture of the lid member 16 is within the second range 303, the urging force of the torsion spring 120 is applied to the engagement member 50. Thus, the lid member 16 is urged in the direction of closing by the torsion spring 120. Further, the movement speed of the lid member 16 is regulated by the damper member 90. Therefore, when the aperture of the lid member 16 is within the second range 303, the movement speed of the lid member 16 is adjusted, similarly to when the aperture is within the first range 301. When the user removes the user's hand from the lid member 16 in a state in which the aperture of the lid member 16 is within the second range 303, the lid member 16 moves such that the aperture of the lid member 16 is on the boundary between the middle range 302 and the second range 303, due to the urging force of the torsion spring 120. Further, at this time, the lid member 16 moves slowly, due to the regulating force of the damper member 90. In this way, the lid member 16 does not stop in a position in the completely open state, but moves to a position in which the aperture of the lid member 16 is on the boundary between the middle range 302 and the second range 303.

When the lid member 16 is closed from the open state (column F in FIG. 5), the user holds the front edge portion 28 (refer to FIG. 2) of the lid member 16 and closes the lid member 16. The lid member 16 rotatingly moves in the anticlockwise direction, as seen in the right side view, around the shaft 56 of the control units 40 and 41. When the aperture of the lid member 16 is within the middle range 302, the engagement pin 82 of the contactor 80 is positioned at the lowermost end of the second cam groove 63 and does not move, as shown in column E. Thus, the movement speed of the lid member 16 is not adjusted by the control units 40 and 41.

When the aperture of the lid member 16 reaches the boundary between the middle range 302 and the first range 301, the engagement member 50 that is not engaged with the engagement pin 82 engages with the engagement pin 82 of the contactor 80, as shown in column D. The engagement pin 82 of the contactor 80 moves from the lowermost portion of the second cam groove 63 to the uppermost portion of the first cam groove 62, while being guided by the protruding portion 53. When the aperture of the lid member 16 is within the first range 301, the engagement member 50 rotates while engaging with the engagement pin 82 of the contactor 80, as shown in column C. The engagement pin 82 of the contactor 80 moves on the first path that is determined by the first cam groove 62 of the cam plate 60 along the cam plate 60, while being supported by the first engagement portion 52 of the engagement member 50. Thus, when the aperture of the lid member 16 is within the first range 301, the movement speed of the lid member 16 is adjusted by the control units 40 and 41. More specifically, the movement speed of the lid member 16, which is defined by the resultant force of the force applied by the user in the direction to close the lid member 16 and the urging force applied in the direction of closing by the torsion spring 120, is regulated by the damper 96. When the user removes the user's hand from the lid member 16 in a state in which the aperture of the lid member 16 is within the first range 301, the lid member 16 slowly moves to a position in which the lid member 16 reaches the closed state.

In the sewing machine 1, when the user performs an operation to open the lid member 16, and when the user performs an operation to close the lid member 16, it is possible to switch between adjusting and not adjusting the movement speed of the lid member 16 depending on the aperture of the lid member 16. The sewing machine 1 can regulate the movement speed of the lid member 16 by the relatively simple configuration of the damper member 90. Further, the sewing machine 1 can reliably switch between adjusting and not adjusting the movement speed of the lid member 16 by the relatively simple configuration of the control units 40 and 41. The sewing machine 1 can inhibit the movement speed of the lid member 16 from becoming excessively large in the vicinity of a position in which the lid member 16 is completely open and in the vicinity of a position in which the lid member 16 is in the closed state. When the aperture of the lid member 16 is within the first range 301, the sewing machine 1 can reliably close the lid member 16, even when the user discontinues the opening/closing operation midway.

More specifically, in a case where the user performs the operation to open the lid member 16, immediately after the lid member 16 starts moving, the aperture of the lid member 16 is within the first range 301. When the aperture of the lid member 16 is within the first range 301, the lid member 16 is urged in the direction of closing of the lid member 16 by the torsion spring 120. Thus, the lid member 16 is inhibited from opening unintentionally. Further, when the lid member 16 moves, the movement speed of the lid member 16 is regulated by the damper member 90. When the aperture of the lid member 16 is within the middle range 302, the movement speed of the lid member 16 is not adjusted by the control units 40 and 41. When the aperture of the lid member 16 is within the middle range 302, compared to a case in which the aperture of the lid member 16 is within the first range 301, the user can operate the lid member 16 with a relatively small force. When the aperture of the lid member 16 is within the second range 303, the movement speed of the lid member 16 is adjusted by the control units 40 and 41. In the vicinity of the position in which the lid member 16 is completely open, the movement speed of the lid member 16 is regulated. As a result, when the lid member 16 is completely open, a load on a coupling section between the lid member 16 and the sewing machine 1 is reduced. Therefore, when the lid member 16 is in the vicinity of the position of being completely open, the sewing machine 1 can reduce an impact that is applied to the lid member 16 and to the main body 2.

In a case where the user performs the operation to close the lid member 16, immediately after the lid member 16 starts moving, the aperture of the lid member 16 is within the middle range 302. In this case, the movement speed of the lid member 16 is not adjusted by the control units 40 and 41. Thus, the user can cause the lid member 16 to move in the direction of closing the lid member 16 with a relatively small force. When the lid member 16 approaches the closed state, the aperture of the lid member 16 is within the first range 301. In this case, the movement speed of the lid member 16, which is the movement speed of the lid member 16 as defined by the force applied to the lid member 16 and the urging force applied by the torsion spring 120, is regulated by the damper 96. As a result, the sewing machine 1 can inhibit the lid member 16 from being closed with a large amount of force.

Further, in the sewing machine 1 of the present embodiment, when the aperture of the lid member 16 is within the first range 301, the lid member 16 can be reliably closed by the urging force of the torsion spring 120. Specifically, the user can completely close the lid member 16 simply by causing the lid member 16 to move to a position within the first range 301. Thus, the user does not need to cause the lid member 16 to move to the position of the closed state.

In recent years, advanced sewing machines that have a variety of built-in functions are being designed such that the advanced sewing machines also have a high quality design in terms of appearance. However, when opening and closing the lid member 16, if the lid member 16 opens or closes with a large amount of force, it may impart a cheap impression. In the sewing machine 1 of the present embodiment, both when the aperture of the lid member 16 is within the first range 301 and when the aperture of the lid member 16 is within the second range 303, the movement speed of the lid member 16 is adjusted such that the lid member 16 moves slowly. Thus, the sewing machine 1 can impart an impression of high quality also when the lid member 16 is being operated.

Generally, around the periphery of the frame portion 36 provided on the upper portion of the main body 2, there is no space to add large structural members. In this respect, as the control units 40 and 41 are relatively compact, it is possible to attach the control units 40 and 41 to the frame portion 36. Further, when the lid member 16 is removed from the main body 2, both the control units 40 and 41 can be removed, and thus it is easy to remove and attach the lid member 16. The control units 40 and 41 can be removed along with the lid member 16. Thus, the control units 40 and 41 do not cause interference when other optional members, such as a thread spool base, are attached to the upper portion of the main body 2.

The sewing machine of the present disclosure is not limited to the above-described embodiment, and various modifications may be applied without departing from the spirit and scope of the present disclosure. For example, the following modifications may be applied as appropriate.

The configuration of the sewing machine 1 may be changed as appropriate. For example, the sewing machine may be another sewing machine, such as an industrial use sewing machine, a multi-needle sewing machine or the like.

The attachment position, the shape and the opening/closing method of the lid member may be changed as appropriate. For example, the lid member may be a lid member that covers the LCD 15 on the front surface of the pillar 12, or may be an upper lid of an auxiliary table that is attached to the machine bed of the sewing machine 1. Further, the lid member 16 has a rotational axis in the left-right direction of the sewing machine 1, but the rotational axis may be in another direction, such as the up-down direction. Further, for example, the lid member 16 may be caused to move by parallel displacement in the up-down direction, as a method of opening and closing the lid member 16. The configuration of the frame portion may be changed as appropriate depending on the attachment position, the shape and the opening/closing method of the lid member. The definition of the aperture of the lid member is not limited to the above-described definition. Any definition is possible, as long as the aperture indicates the extent to which the lid member is open.

The attachment position and the number of the control units with respect to a single lid member may be changed as appropriate. For example, the lid member 16 may be supported by the one control unit 40 and by a general-purpose attachment member, such as a support shaft, such that the lid member 16 can open and close. The control unit 40 may be fixed to the frame portion 36.

The configuration of the control units 40 and 41 may be changed as appropriate depending on the attachment position, the shape and the opening/closing method of the lid member 16, and on the range over which the movement speed of the lid member 16 is adjusted etc. The modifications exemplified below may be added as appropriate, for example.

The configuration of the contactor 80 may be changed as appropriate. For example, a configuration may be adopted in which the engagement pin 82 does not directly come into contact with the cam groove 61. A configuration may be adopted in which the engagement pin 82 rotatably supports a cylindrical roller and the cylindrical roller comes into contact with the cam groove 61. With this configuration, it is possible to further reduce friction that occurs when the engagement pin 82 of the contactor 80 comes into contact with the cam groove 61.

The torsion spring may be another elastic member, such as an extension spring or the like. Above, the elastic member urges the engagement member 50 both when the aperture of the lid member 16 is within the first range and when the aperture of the lid member 16 is within the second range. However, the elastic member may urge the engagement member 50 only when the aperture of the lid member 16 is within one of either the first range or the second range.

The configuration of the damper member 90 may be changed as appropriate. For example, the damper 96 and the contactor 80 may be directly coupled, without using the wheel 91 and using the damper 96 alone as the damper member. Further, the damper 96 is not limited to the rotary damper and any damper can be used as long as the damper 96 can attenuate the kinetic energy of the lid member 16.

The members that configure the control units 40 and 41 may be added or omitted as necessary. For example, the elastic member may be omitted as necessary. More specifically, in a case where the elastic member (the torsion spring 120) is omitted in the above-described embodiment, the movement speed of the lid member 16 is regulated by the damper member 90 both when the aperture of the lid member 16 is within the first range and within the second range. In this case, the movement speed of the lid member 16 is regulated both when the lid member 16 is in the vicinity of the position of being completely closed, and when the lid member 16 is in the vicinity of the position of being completely open. As a result, it is possible to inhibit the lid member 16 from closing or opening with a large amount of force. Further, when the movement speed of the lid member 16 is regulated both when the aperture of the lid member 16 is within the first range and within the second range, the control unit may be configured as described below, for example. The shape of the gear portion 94 may be changed such that the gear portion 94 of the wheel 91 meshes with the gear portion 97 of the damper 96 when the aperture of the lid member 16 is within the first range and within the second range, for example, and such that the gear portion 94 does not mesh with the gear portion 97 when the aperture of the lid member 16 is within the middle range. Then, the lid member 16 may be directly fixed to the wheel 91, and the torsion spring 120, the contactor 80, the cam plate 60 and the engagement member 50 may be omitted.

The first range and the second range may be changed as appropriate. For example, the movement speed of the lid member 16 may be adjusted when the aperture of the lid member 16 is within either the first range 301 or the second range 303 only. To adjust the movement speed of the lid member 16 only when the aperture of the lid member 16 is within the first range, the second engagement portion 55 is not provided, for example, and the arc-shaped portion 54 may extend as far as the section in which the second engagement portion 55 is provided. In this case, of the above-described effects, the effect can be obtained when the user closes the lid member 16. With respect to the above-described embodiment, to adjust the movement speed of the lid member 16 only when the aperture of the lid member 16 is within the second range, the first engagement portion 52 and the protruding portion 53 are not provided, for example, and the arc-shaped portion 54 may extend as far as the section in which the protruding portion 53 is provided. In this case, of the above-described effects, the effect can be obtained when the user opens the lid member 16. Further, for example, the width of the first range and the second range may be changed, respectively, as appropriate.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a frame portion;

a lid member attached to the frame portion such that the lid member can open and close; and a control portion configured to control a movement speed of the lid member depending on an aperture of the lid member, wherein the control portion is configured to switch between adjusting the movement speed and not adjusting the movement speed depending on the aperture of the lid member, and configured to adjust the movement speed when the aperture is within a first range, the first range being a range that includes an aperture when the lid member is completely closed.

2. The sewing machine according to claim 1, wherein the control portion includes a damper member configured to regulate the movement speed.

3. The sewing machine according to claim 2, wherein the control portion further includes a cam fixed to the frame portion;

a contactor coupled to the damper member and configured to move along the cam; and an engagement member coupled to the lid member and configured to engage with the contactor, and wherein when the aperture is within the first range, the contactor moves on a first path along the cam while engaging with the engagement member, and the damper member regulates the movement speed of the lid member that is coupled to the engagement member in a case where the contactor that is engaged with the engagement member moves on the first path.

4. The sewing machine according to claim 3, wherein when the aperture is within a second range, the contactor moves on a second path along the cam while engaging with the engagement member, the second range being a range that includes an aperture when the lid member is completely open, and the damper member regulates the movement speed of the lid member that is coupled to the engagement member in a case where the contactor that is engaged with the engagement member moves on the second path.

5. The sewing machine according to claim 4, wherein the control portion further includes an elastic member coupled to the damper member, and wherein the elastic member urges the engagement member in a direction of closing of the lid member when the engagement member and the contactor are engaged with each other.

6. The sewing machine according to claim 4, wherein the engagement member does not engage with the contactor when the aperture is within a third range, the third range being a range that is located between the first range and the second range.

7. The sewing machine according to claim 3, wherein the control portion further includes an elastic member coupled to the damper member, and wherein the elastic member urges the engagement member in a direction of closing of the lid member when the engagement member and the contactor are engaged with each other.

8. The sewing machine according to claim 2, wherein the control portion further includes a cam fixed to the frame portion;

a contactor coupled to the damper member and configured to move along the cam, and an engagement member coupled to the lid member and configured to engage with the contactor, and wherein when the aperture is within a second range, the contactor moves on a second path along the cam while engaging with the engagement member, the second range being a range that includes an aperture when the lid member is completely open, and the damper member regulates the movement speed of the lid member that is coupled to the engagement member in a case where the contactor that is engaged with the engagement member moves on the second path.

9. The sewing machine according to claim 8, wherein the control portion further includes an elastic member coupled to the damper member, and wherein the elastic member urges the engagement member in a direction of closing of the lid member when the engagement member and the contactor are engaged with each other.

* * * * *